US005751664A

United States Patent [19]

Higuchi et al.

[11] Patent Number: 5,751,664

[45] Date of Patent: May 12, 1998

[54] HAND ROTATING MECHANISM FOR ELECTRONIC WATCH

[75] Inventors: Haruhiko Higuchi, Tokorozawa; Noritoshi Suzuki, Kawaguchi, both of Japan

[73] Assignee: Citizen Watch Co., Ltd., Tokyo, Japan

[21] Appl. No.: 575,085

[22] Filed: Dec. 19, 1995

[30] Foreign Application Priority Data

Dec. 27, 1994 [JP] Japan ..... 6-324371

[51] Int. Cl.[6] ..... G04B 15/00

[52] U.S. Cl. ..... 368/112; 368/28; 368/124; 368/76

[58] Field of Search ..... 368/28, 29, 35–37, 368/76, 185, 80, 184, 220, 110, 223, 124, 112

[56] References Cited

U.S. PATENT DOCUMENTS 4,108,016 8/1978 Muranishi ..... 74/462
5,235,562 8/1993 Vaucher ..... 368/28
5,305,289 4/1994 Besson et al. ..... 368/28
5,481,188 1/1996 Mizutani ..... 324/207.5

FOREIGN PATENT DOCUMENTS 62-291591 12/1987 Japan .
3-160393 7/1991 Japan .

*Primary Examiner*—Bernard Roskoski
*Attorney, Agent, or Firm*—Dickstein Shapiro Morin & Oshinsky LLP

[57] ABSTRACT

In an electronic watch, a hand wheel gear **109*b* in a gear train has a tooth 124 having a profile K so as to prevent the backward movement of a hand 104. During initialization, the gear train is rotated backward such that the hand 104 is turned to the backward movement preventing position, which serves as an initializing position, and a reference position during detection of a hand position. Usually, a backward movement command is issued when the hand 104 is supposed to be at the reference position. The hand 104** is judged to be out of the reference position when its backward movement is detected.

22 Claims, 10 Drawing Sheets

HAND ROTATING MECHANISM FOR ELECTRONIC WATCH

BACKGROUND OF THE INVENTION

1. Field of the Invention

This invention relates to a hand rotating mechanism for an electronic watch, and more particularly to a hand rotating mechanism for detecting a deviation of an actual hand position from a reference hand position estimated in response to an electric signal.

2. Description of the Prior Art

As analog watches have become more versatile, some of them not only measure and indicate time but also include an alarm watch, a stopwatch, and so on. Such a watch has a plurality of rotating hands dedicated for respective functions. It is essential that each rotating hand has its absolute position in agreement with hand position data of the watch. In the case of a watch indicating time only, its time indication may be out of order due to factors such as sticking of a hand, shocks applied to the watch, and so on.

A variety of proposals have been made for detecting the absolute position of the hands. For instance, Japanese Patent Laid-Open Publication No. Hei 3-160393 discloses a photo detecting method using a photointerrupter. Further, Japanese Patent Laid-Open Publication No. Sho 62-291591 proposes a method for detecting the absolute position of the hands by detecting a variation of load generated at a mechanism which is incorporated in a part of a gear train.

In the former method, it is necessary to dispose light emitting and receiving elements in the gear train. This would restrict design tolerance in a watch having a limited space. An increase in the number of components will raise manufacturing cost. Further, this method is disadvantageous in that a lot of current is consumed to operate a photo detecting circuit.

No additional components are required in the latter load variation detecting method in addition to the gear train. However, a load on the gear train normally tends to vary slightly, and may excessively fluctuate when the watch is put in an abnormal environment, or is subject to strong vibrations or shocks. When a variation of gear train load is detected, it is difficult to determine whether the variation is caused by the gear train itself, or by some other factors. This means that hand positions are detected rather unreliably.

SUMMARY OF THE INVENTION

It is one object of the invention to provide a hand rotating mechanism for an electronic watch, which can be realized without increasing the number of components, consumes reduced power, and can accurately detect a deviation of a hand from its reference position. A further object of the invention is to provide a hand rotating mechanism for an electronic watch, which can correct a deviation of a hand. A still further object of the invention is to provide a hand rotating mechanism for an electronic watch, which can adjust a hand at an initializing position during the initialization.

According to a first aspect of the invention, there is provided a hand rotating mechanism for an electronic watch in which at least a hand is rotated forward and backward by a motor converting an electrical signal from a control circuit in to the rotary motion. The hand rotating mechanism comprises: a backward movement preventing mechanism for preventing the backward movement of the hand only at a predetermined backward movement preventing position; a backward movement commanding circuit for commanding the motor to move the hand backward when a position of the hand estimated on the basis of the electrical signal agrees with the backward movement preventing position; a backward movement detecting circuit for detecting that the hand actually moves backward; and a hand position determining circuit for determining that an actual position of the hand agrees with the estimated position when the backward movement of the hand is not detected, and determining that the actual position of the hand deviates from the estimated position when the backward movement of the hand is detected.

In this arrangement, if the backward movement of the hand is not detected in spite of the backward movement command, the hand is considered to be at a presumed position, i.e. a normal position. Conversely, the hand is considered to be out of the presumed position when the backward movement thereof is detected.

The hand rotating mechanism may include a hand positioning circuit which repositions the hand to its estimated position when it is not there. This enables the hand to be returned to its normal position.

The positioning circuit issues a command for the motor to cause the hand to make less than one forward rotation and thereafter to cause the hand to make one backward rotation. The positioning member can accurately correct the hand position without adversely affecting the time indication.

The positioning means issues a command for the motor to cause the hand to make less than one forward rotation and thereafter cause the hand to make one backward rotation, calculates time for repositioning the hand, and demands the motor to move the hand on the basis of the calculated time. It is possible to accurately correct the hand position without varying the time indication. Further, even when it takes a long time to correct the hand position, the watch can keep good time.

The motor is controlled such that rotational torque for rotating the hand in response to the backward movement command is larger than that for the forward movement of the hand. Usually, the force for advancing the hand is set to be minimum so as to save power consumption. However, the backward movement of the hand can be accurately detected by increasing the force for rotating the hand backward.

The motor is a stepping motor, the backward movement command circuit commands the motor to move the hand backward first and then move it forward, and the backward movement detecting circuit detects whether or not the hand actually moves forward in response to the forward movement command after the backboard movement command, and determines that the motor actually rotates backward when the forward movement of the hand is detected. Usually, the forward movement of the hand can be reliably detected. The backward movement of the hand is indirectly detected through the detection of the forward movement thereof. This enables the backward movement of the hand to be more reliably detected.

The motor is controlled such that rotational torque for moving the hand in response to the backward movement command is larger than that for the forward movement of the hand. This is also effective in promoting accurate detection of the backward movement of the hand.

The backward rotating commanding circuit commands the motor to move the hand backward when the number of times in which the estimated position of the hand agrees with the backward movement preventing position becomes larger than a given value. This circuit is effective in reducing the power to be consumed for confirming the hand position, and lengthening the life of a battery.

The hand rotating mechanism further includes a gear train for transmitting the rotation of the motor to the hand, and one of the gears in the gear train has at least one tooth functioning as the backward movement preventing mechanism. The backward movement of the hand is prevented by the teeth having different profiles, which can be realized without incorporating additional members.

One of the teeth of the gear acting as the backward movement preventing mechanism has a projecting portion which comes into engagement with a tooth of the mating gear in the gear train during the backward movement of the hand.

The other tooth of the gear acting as the backward movement preventing mechanism is a third tooth viewed from the tooth having the projecting portion in the forward rotating direction and is slender on a side thereof where it comes into engagement with a tooth of the mating gear in the gear train during the backward movement of the hand.

The other tooth of the gear acting as the backward movement preventing mechanism may be a second tooth viewed from the tooth having the projecting portion in the forward rotating direction and is slender on a side thereof where it comes into engagement with another tooth of the mating gear in the gear train during the backward rotation of the motor.

The hand rotating mechanism further includes an initializing circuit for demanding the motor to move the hand backward during initialization. The watch can be initialized when it is turned on.

According to a second aspect of the invention, there is provided a hand rotating mechanism for an electronic watch in which at least one hand is rotated forward and backward by a motor converting an electrical signal from a control circuit into rotary motion. The hand rotating mechanism comprises a backward movement preventing mechanism for preventing the backward movement of the hand only at a predetermined backward movement preventing position; and an initializing circuit for demanding the motor to rotate the hand backward toward the backward movement preventing position during initialization.

In this arrangement, the backward movement preventing position can serve as an initializing position, to which the hand can be easily positioned.

The hand rotating mechanism further includes a gear train for transmitting the rotation of the motor to the hand, and one of the gears in the gear train has at least one tooth functioning as the backward movement preventing mechanism. This mechanism can be realized without using additional components.

One of the teeth of the gear acting as the backward movement preventing mechanism has a projecting portion which comes into engagement with a tooth of the mating gear in the gear train during the backward movement of the hand.

The other tooth of the gear acting as the backward movement preventing mechanism is a third tooth viewed from the tooth having the projecting portion in the forward rotating direction and is slender on a side thereof where it comes into engagement with a tooth of the mating gear in the gear train during the backward movement of the hand.

The foregoing tooth of the gear acting as the backward movement preventing mechanism may be a second tooth viewed from the tooth having the projecting portion in the forward rotating direction and is slender on a side thereof where it comes into engagement with another tooth of the mating gear in the gear train during the backward movement of the motor.

In accordance with the invention, the electronic watch having a variety of functions such as an alarm watch and a stopwatch can be automatically initialized with reduced assistance by the user. When the watch offers only ordinary time indication, a wrong time indication caused by shocks and so on can be accurately corrected. Further, positions of gears in a gear train can be reliably detected by a simple system without increasing the number of components therein. Therefore, the watch can incorporate a gear train position detect or without any problem with respect to its configuration, and can be prevented from suffering a spoiled external appearance or being enlarged.

BRIEF DESCRIPTION OF THE DRAWINGS

An embodiment of the invention will now be described, by way of example, with reference to the accompanying drawings in which.

DETAILED DESCRIPTION OF THE PREFERRED EMBODIMENT

The invention will be described with reference to a preferred embodiment shown in FIG. 1 to FIG. 4 showing a gear train mechanism.

Figure 1:
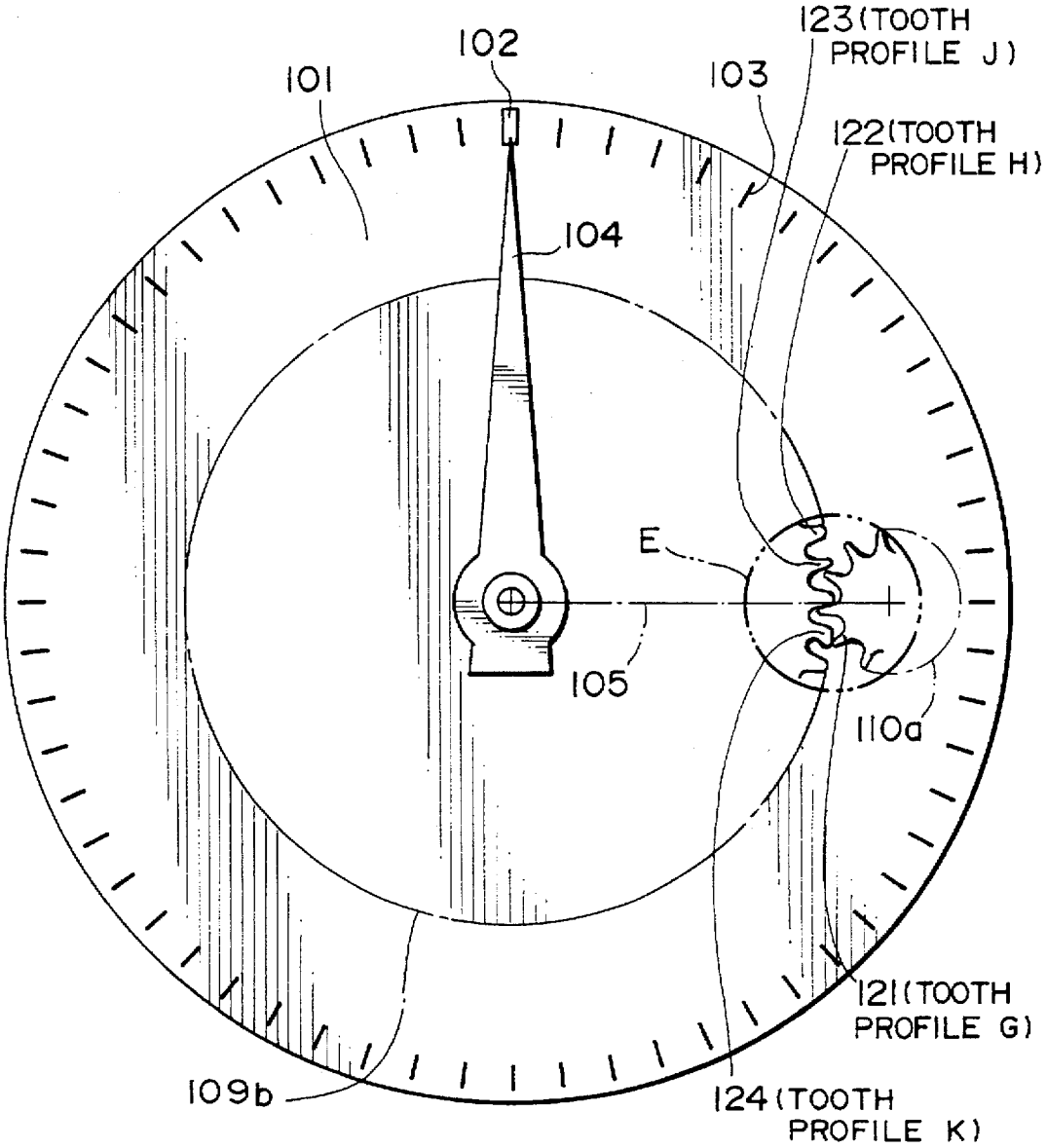
FIG. 1 is a front, partly exploded, view of an electronic watch according to a preferred embodiment of the invention.

Referring to FIG. 1, an electronic watch includes a dial 101 and a hand 104. The hand 104 normally rotates clockwise. Hereinafter, the word "forward" denotes the direction in which the wheels rotate so as to advance the hand, while the word "backward" denotes the direction in which the wheels rotate so as to retreat the hand from its current position. The hand 104 may be turned counterclockwise during time adjustment or maintenance. According to the invention, a deviation of a hand position is detected as described later when the hand 104 is the 12 o'clock position on the dial 101. The 12 o'clock position is hereinafter called "reference position 102". Further, the reference position 102 is also used as a base for initializing the time indication.

In FIG. 1, the hand 104 stays at the reference position 102 after turning counterclockwise in response to a given command (to be described later). In this state, a hand wheel gear 109*b* is engaged with a first intermediate wheel pinion 110*a* as shown at a portion E in FIG. 1.

Figure 2:
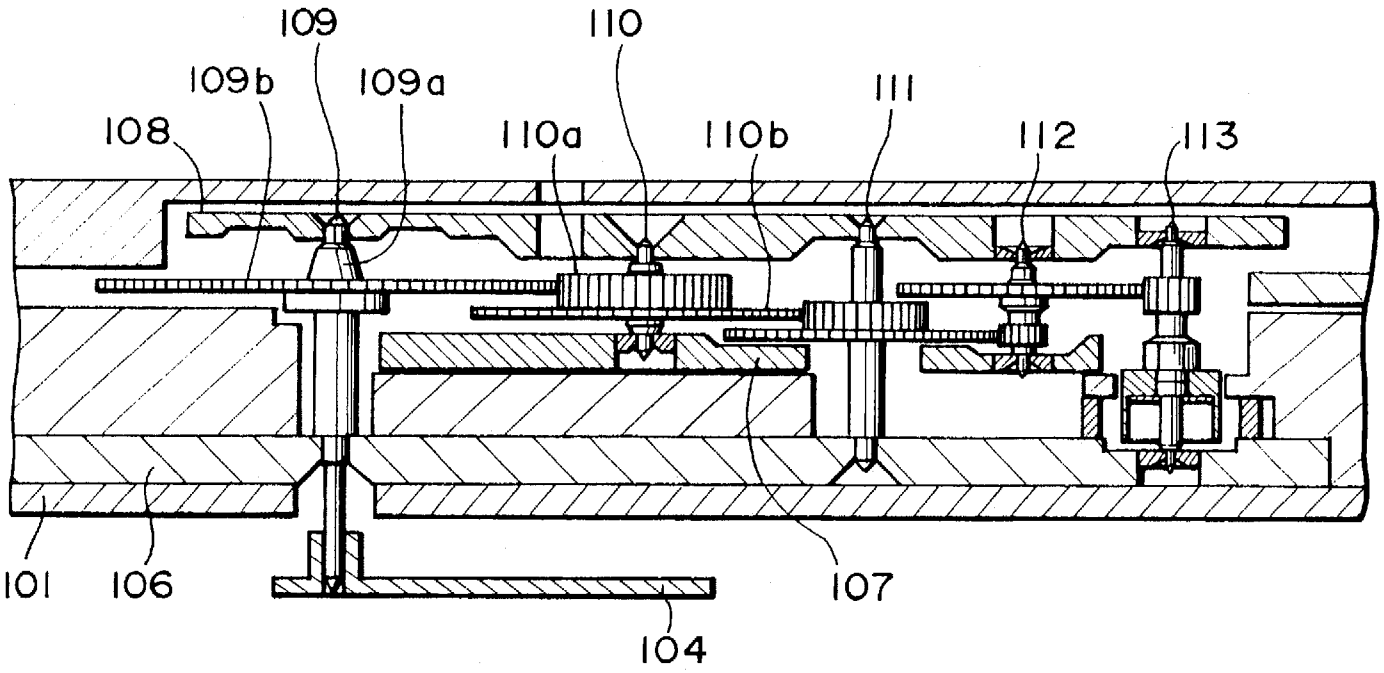
FIG. 2 is a cross section of the electronic watch of FIG. 1, showing the configuration on of a gear train.

FIG. 2 is a cross section of a gear train between a rotor 113 of a motor driven in response to an electrical signal and a hand wheel 109 for turning the hand 104. The gear train transmits a rotational force of the motor to the hand wheel 109.

The hand wheel 109 includes a hand wheel staff 109*a* for securing the hand 104 thereon, and the hand wheel gear 109*b*. The first intermediate wheel 110 for rotating the hand wheel gear 109*b* includes a first intermediate wheel pinion 110*a* and a first intermediate wheel gear 110*b*. The first intermediate wheel pinion 110*a* and the hand wheel gear 109*b* are in engagement with each other. Second and third intermediate wheels 111 and 112 are structured similarly to the first intermediate wheel 110. Wheel pinions and wheel gears associated with the second and third intermediate wheels 111 and 112 are engaged with each other, thereby extending to the rotor 113.

The rotor 113 rotates so as to sequentially turn the third, second and first intermediate wheels 112, 111 and 110 in this order. The first intermediate wheel pinion 110*a* rotates the hand wheel gear 109*b*, thereby rotating the hand 104.

A gear mechanism of the invention differs from the prior art in that the first intermediate wheel pinion 110*a* is engaged with the hand wheel gear 109*b* such that the hand 104 always stops at the reference position 102 on the dial 101 when it turns counterclockwise.

Tooth profiles which are one of the features of the invention will be described with reference to FIG. 1. The first intermediate wheel pinion 110*a* has teeth 121 with a profile G, and are similar to ordinary gears. The hand wheel gear 109*b* has a plurality of teeth 122 with a profile H, one tooth 124 with a deformed profile K, and one tooth 123 with a deformed profile J. Specifically, the tooth 124 has a thick tip as shown at the portion E in FIG. 1. When moved backward, the hand wheel gear 109*b* engages, using its tooth 122, with the first intermediate wheel pinion 110*a*. The tooth 123 is more slender than the remaining teeth 122 and 124.

The first intermediate wheel pinion 110*a* has the teeth 121 of the profile G, and engages with the hand wheel gear 109*b* in three ways, i.e. the teeth with the profile G (called "teeth G") engage with the teeth with the profile H (called "teeth H"), the tooth G engages with the tooth with the profile J (called "tooth J"), and the tooth G engages with the tooth with the profile K (called "tooth K").

First of all, the teeth G and the teeth H engage with each other similarly to ordinary teeth of a gear which is rotatable forward and backward. Each of teeth G and H has a symmetrically curved shape. When the first intermediate wheel 110 is rotating forward, the hand wheel gear 109*b* can rotate freely forward or backward smoothly following the rotation of the first intermediate wheel pinion 110*a*. The teeth G have wider spaces between tips thereof so as to span over the thick tip of the tooth K.

Figure 3:
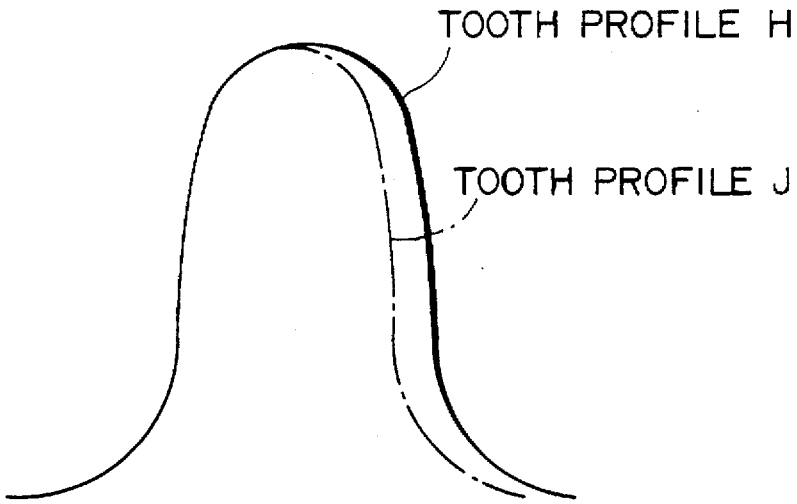
FIG. 3 is a detailed view of a tooth of the wheel gear.

The teeth G and J engage with each other as follows. Referring to FIG. 3, the tooth J is shaped similarly to the tooth H at a side where the rotational force is applied via the tooth G during the forward rotation. On the other hand, the side where the backward rotational force is applied via the tooth G recedes compared with the foregoing side, and is shaped similarly to that of the tooth H. In other words, the tooth J is more slender than the tooth H, but is curved and shaped similarly to the tooth H. Thus, the teeth G and J engage with each other in substantially the same manner as the teeth G and H.

Figure 4:
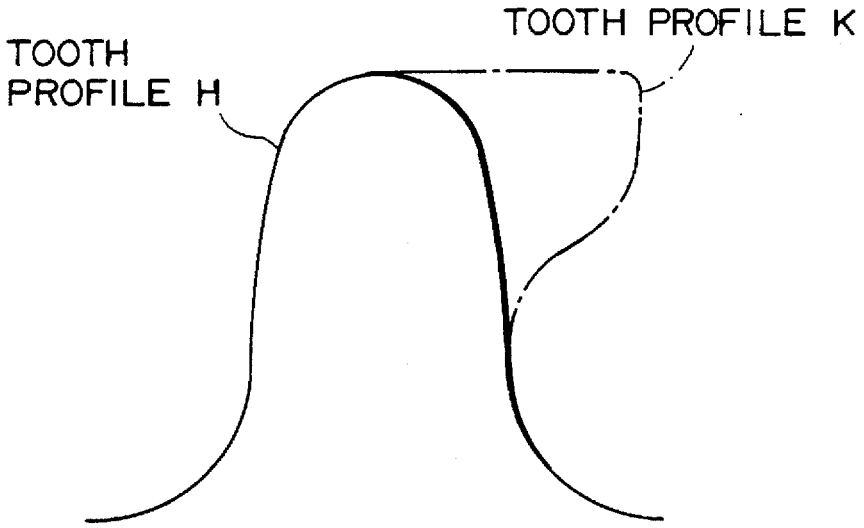
FIG. 4 is a detailed view of another tooth of the wheel gear.

The following describe the engagement of the tooth G with the tooth K. Referring to FIG. 4, the tooth K has the shape curved similarly to the tooth H at a side where the rotational force is applied via the tooth G during the forward rotation. However, the tooth K has a projecting portion on its side to which a rotational force is applied during the backward movement. The projecting portion of the tooth K prevents the tooth G from getting into a space between the tooth K and an adjacent tooth H.

When the first intermediate wheel pinion 110*a* is rotated so as to move the hand 104 backward, the tooth G is blocked by the projecting portion of the tooth K, thereby causing the hand 104 to stop. Thus, the hand wheel gear 109*b* can always stop its rotation at the given position because of the presence of the tooth K when the hand 104 is moved backward.

On the contrary, when the first intermediate wheel pinion 110*a* is rotated backward, the tooth G spans over the projecting portion of the tooth K. Thus, the teeth G and K are relative to each other similarly to the teeth G and H.

The hand 104 is secured to the wheel staff 109*a* such that the hand 104 indicates the reference position 102 on the dial 101 when it is stopped at the foregoing given position. When the rotor 113 is rotated so as to move the hand 104 backward, the hand 104 is made to stop at the reference position 102.

Engagement between the wheel gears will be described in detail in accordance with the forward and backward movements of the hand 104, referring to FIGS. 5A to 5C and FIGS. 6A to 6C.

Figure 5A:
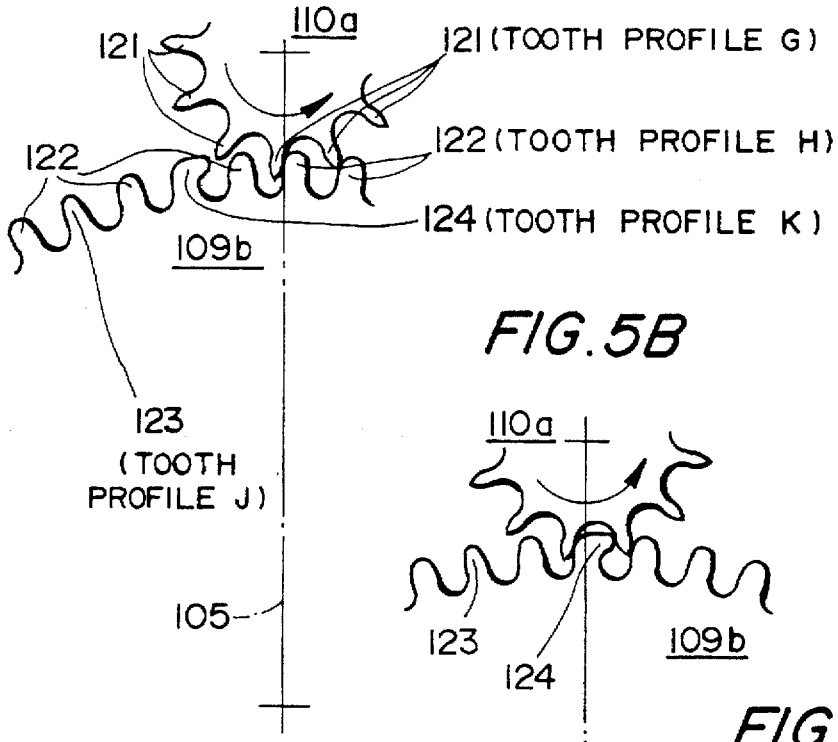
FIG. 5A, FIG. 5B and FIG. 5C schematically show how a first intermediate wheel pinion engages with a hand wheel gear rotating forward.
Figure 5B:
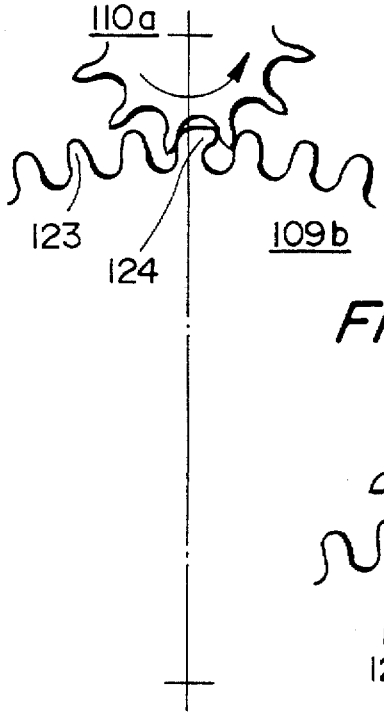
Figure 5C:
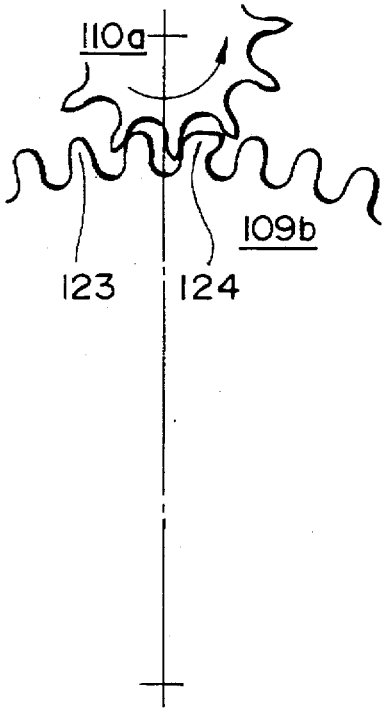

FIG. 5A shows the state in which the hand wheel gear 109*b* engages with the first intermediate wheel pinion 110*a* during the forward rotation, especially showing how the tooth K of the hand wheel gear 109*b* engages with the teeth G of the first intermediate wheel pinion 110*a*. As shown in FIGS. 5B and 5C, teeth of the hand wheel gear 109*b* sequentially engage with teeth of the first intermediate wheel pinion 110*a* as the hand 104 keeps on rotating forward.

Figure 6A:
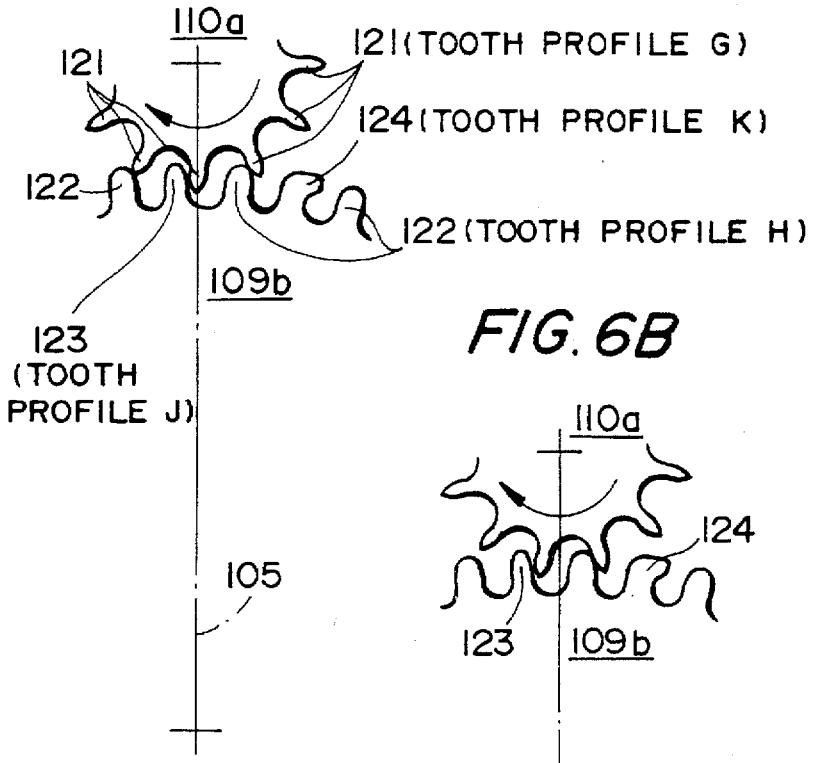
FIG. 6A, FIG. 6B and FIG. 6C schematically show how the first intermediate wheel pinion engages with the hand wheel gear rotating backward.
Figure 6B:
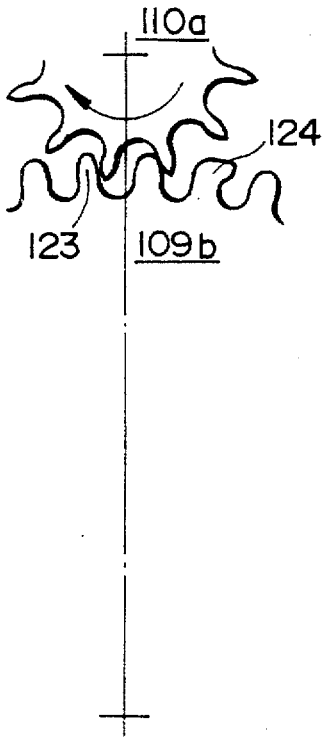
Figure 6C:
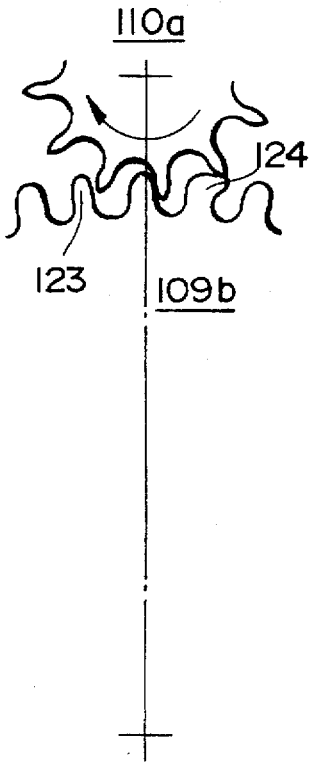

Referring to FIGS. 6A to 6C, teeth of the hand wheel gear 109*b* sequentially engage with teeth of the first intermediate wheel pinion 110*a* as the hand 104 keeps on rotating backward. Specifically, FIG. 6C shows that the hand 104 is made to stop.

As shown in FIGS. 5A to 5C, teeth G push the left sides of teeth H so as to rotate the hand wheel gear 109*b*. Similarly, teeth G push the left sides of the teeth J and K so as to rotate the hand wheel gear 109*b*. In this state, the teeth G span across the tooth K having the rotation-preventing projection, so both the first intermediate wheel pinion 110*a* and the hand wheel gear 109*b* keep on rotating without any problem. In other words, the hand 104 can continue its forward movement.

In order to move the hand 104 backward, teeth G push the right sides of teeth H, as shown in FIGS. 6A to 6C. Teeth G push the tooth J at the right side thereof, are in short engagement with the slender tooth J (as shown in FIG. 6A), disengage therefrom quickly, and keep on moving. Then, the teeth G shift to the states as shown in FIGS. 6B and 6C.

Referring to FIG. 6C, one of teeth G comes into contact with the tooth K, which prevents further rotations of the first intermediate wheel pinion 110*a* and the hand wheel gear 109*b*. On the hand wheel gear 109*b*, a second tooth, viewed from the backward rotating direction of the tooth K, has the profile J in place of the profile H such that the tip of the tooth G can be reliably engaged with the tooth K. Thus, the hand 104 is caused to stop without fail. If the tooth J were as thick as the tooth H or if it were thicker than the tooth H due to manufacturing errors or the like, a tooth G would not come into engagement with the tooth J, but would probably span over the tooth K as shown in FIG. 5B. In such a case, it is not possible to stop the hand 104 at the predetermined position when it is rotating in a certain direction.

Figure 7:
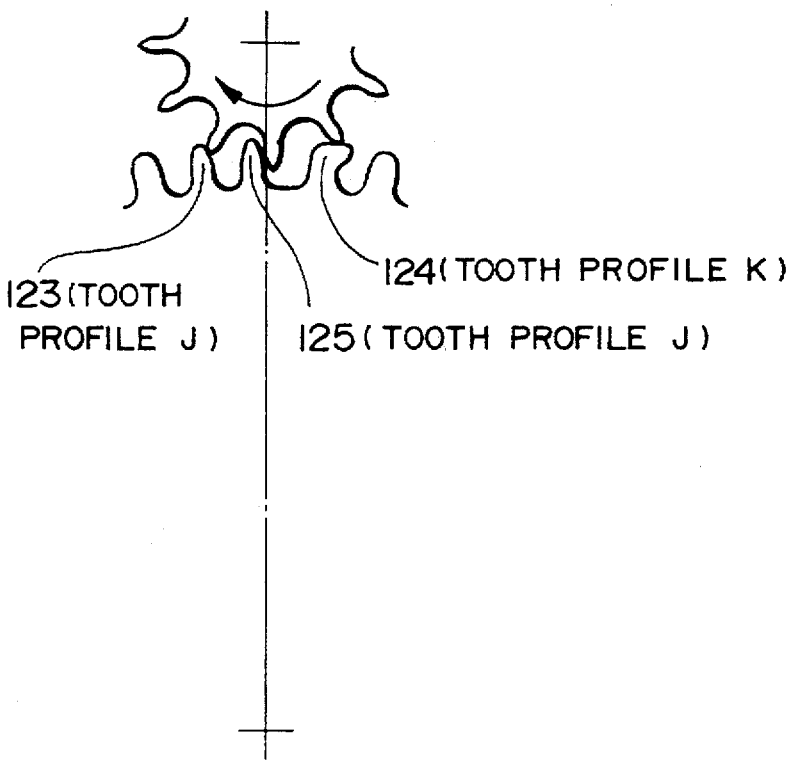
FIG. 7 shows another configuration of the first intermediate wheel pinion and the hand wheel gear.

As shown in FIG. 7, one of teeth of the hand wheel gear 109*b*, i.e. a tooth next to the tooth K viewed in the forward rotating direction thereof, may have the slender profile J, so the tooth G of the gear wheel 110*a* reliably engages with the tooth K.

In this embodiment, the teeth of the hand wheel gear 109*b* and those of the first intermediate wheel pinion 110 function as a backward movement preventing unit.

A procedure for detecting the hand position using the foregoing gear train will be described hereinafter.

Figure 8:
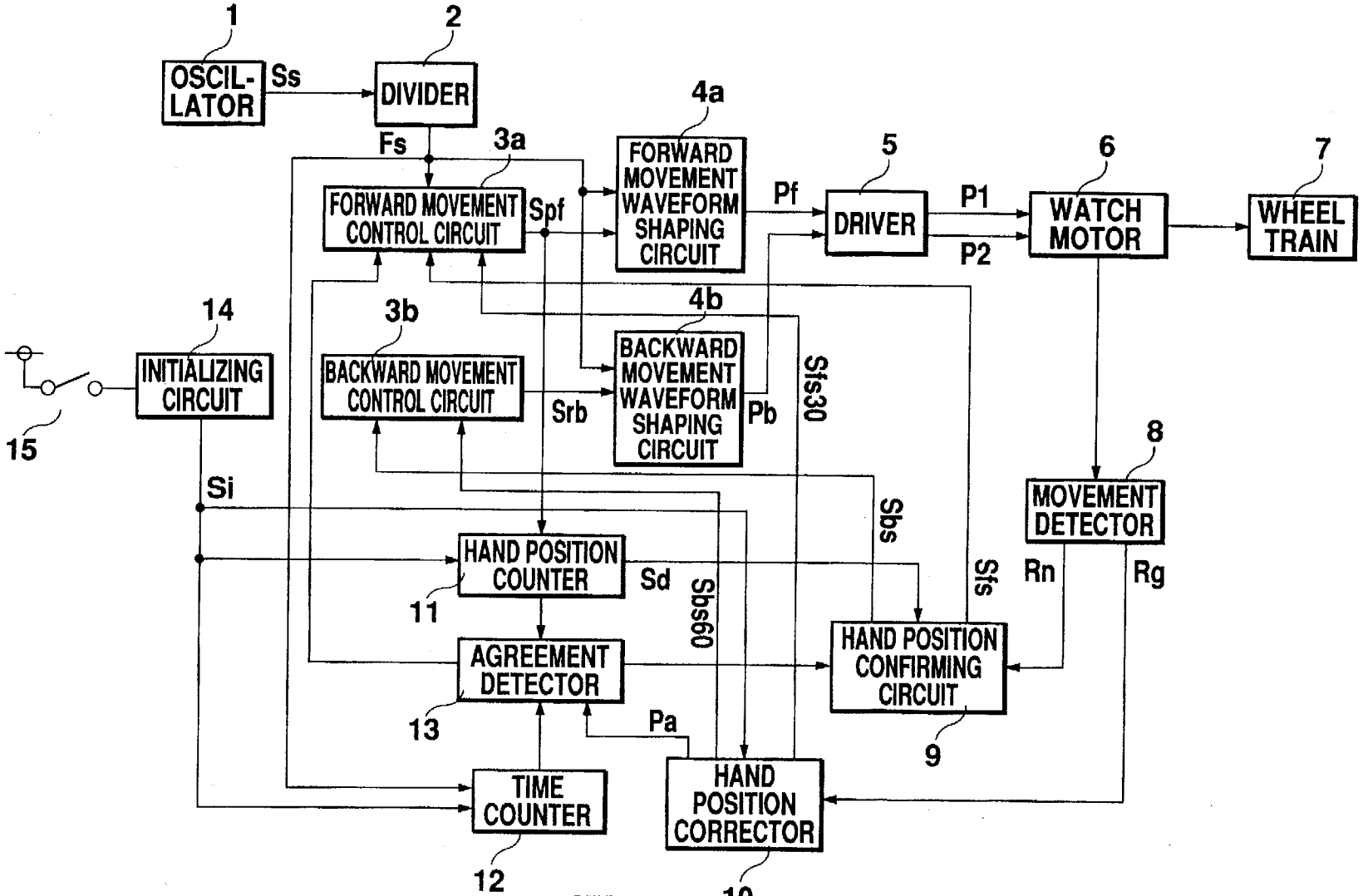
FIG. 8 is a block diagram of a driver in the preferred embodiment.

The electronic watch having the foregoing gear train is operated by a system configured as shown in FIG. 8.

In the following description, the hand wheel gear 109*b* is assumed to have 60 teeth, one of which is the tooth K. The hand 104 is assumed to be a second hand which usually takes one forward step every second. The rotational force of the rotor 113 is transmitted to the hand wheel 109 via the first and second intermediate wheel gears 111 and 112. With respect to the gear train 7 (shown in FIG. 8), a gear ratio between the rotor 113 and the hand wheel 109 is set to be 30 to 1.

Figure 9:
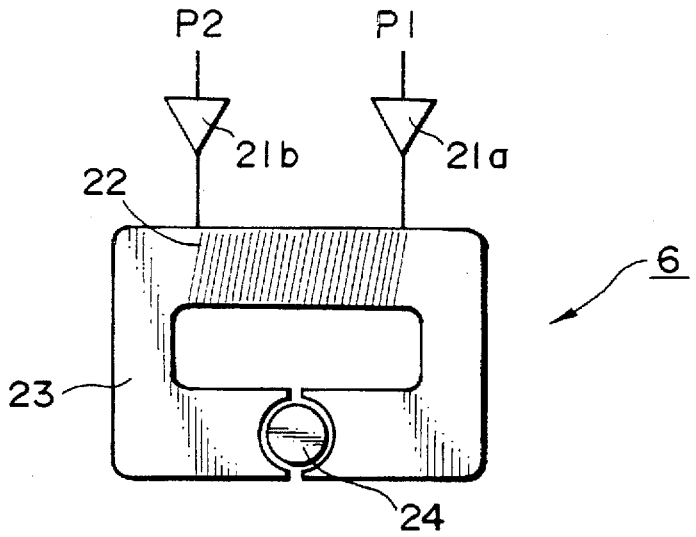
FIG. 9 is a front view of a watch motor.
Figure 10A:
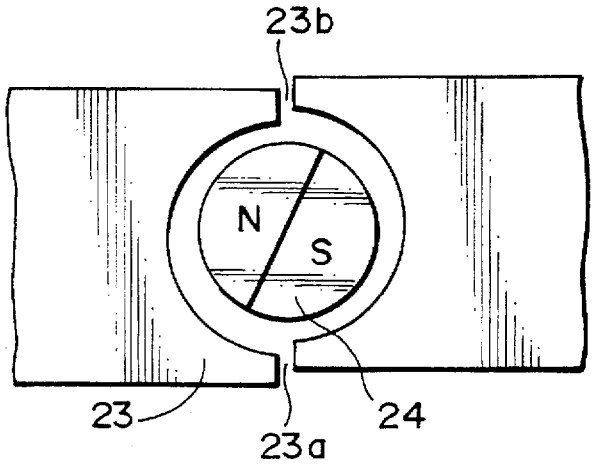
FIG. 10A and FIG. 10B schematically show two states of a rotor.
Figure 10B:
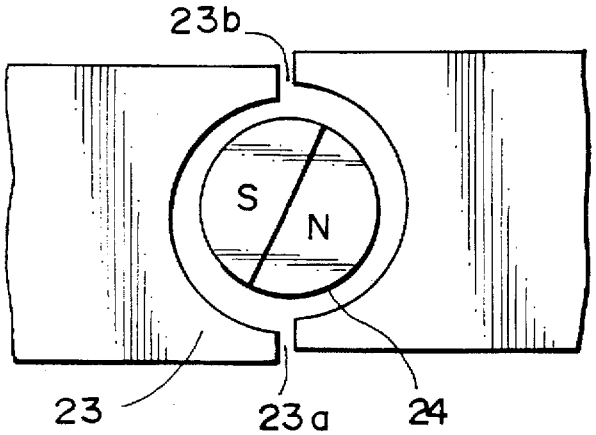

The watch motor 6 is a bipolar stepping motor which is structured as shown in FIGS. 9, 10A and 10B.

In operation, the motor 6 of FIG. 9 is driven as shown in FIGS. 10A, 10B, 11A to 11D, 12A and 12B. FIGS. 10A, 10B and 11A to 11D are plan views of a part of a stator 23, and a rotor 24. FIGS. 12A to 12D are time charts of drive signals provided by motor drivers 21*a* and 21*b*.

Figure 11A:
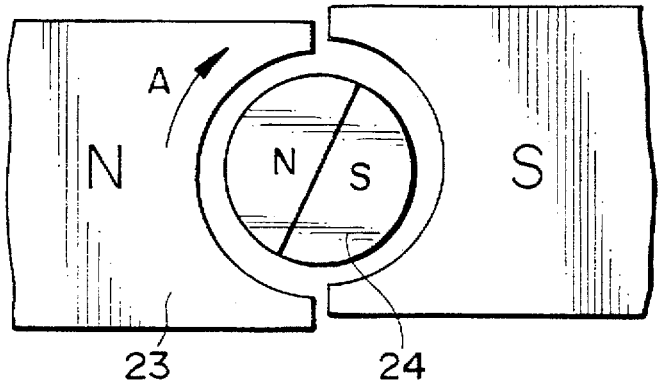
FIG. 11A, FIG. 11B FIG. 11C and FIG. 11D show operation sequences of the rotor.

The stator 24 can assume two positions with respect to the rotor 23 as shown in FIGS. 10A and 10B while the motor 6 is stationary. When the rotor 24 is in a state as shown in FIG. 10A, the motor drivers 21*a* and 21*b* output drive signals P1 and P2 shown in FIG. 12A. Then, a current flows through a coil 22, so the stator 23 is energized as shown in FIG. 11A. The stator 23 makes a half turn in the direction shown by an arrow A (FIG. 11A).

Figure 11B:
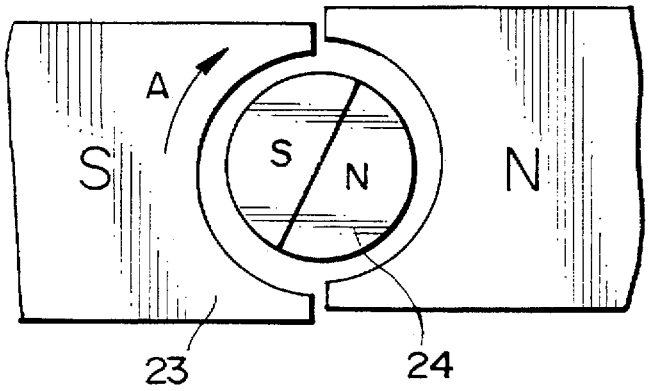
Figure 11C:
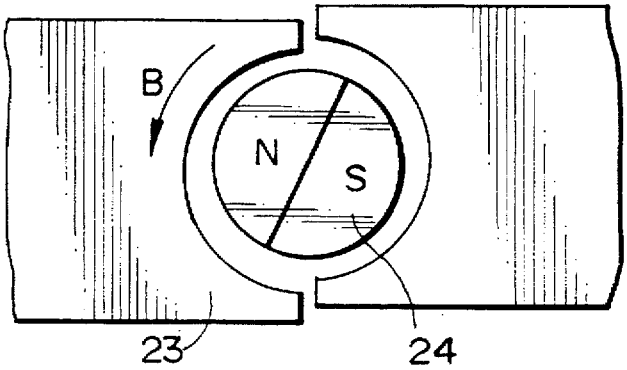
Figure 11D:
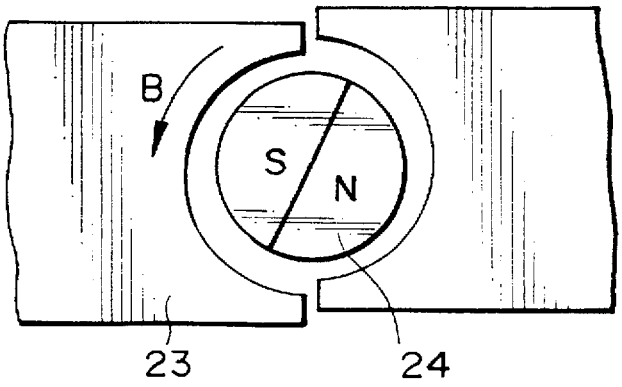
Figure 12A:
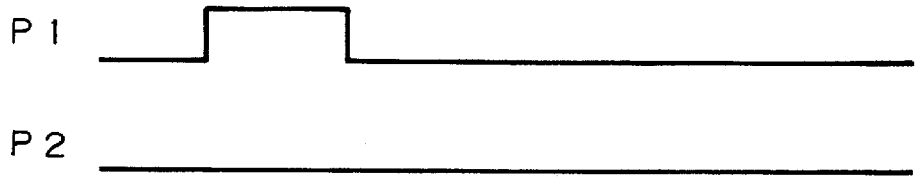
FIG. 12A, FIG. 12B, FIG. 12C and FIG. 12D are time charts showing drive signals for the watch motor.
Figure 12B:
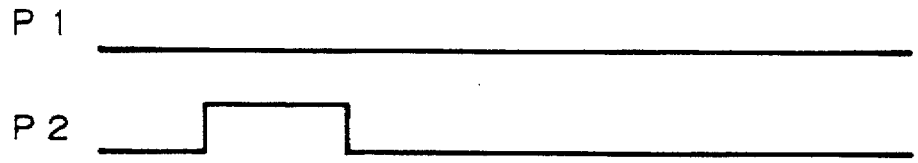

In response to next drive signals P1 and P2 shown in FIG. 12B, the stator 23 is energized as shown in FIG. 11B. Thus, the rotor 23 makes a half turn in the direction A (shown in FIG. 11B). The direction A is assumed to be forward.

Figure 12C:
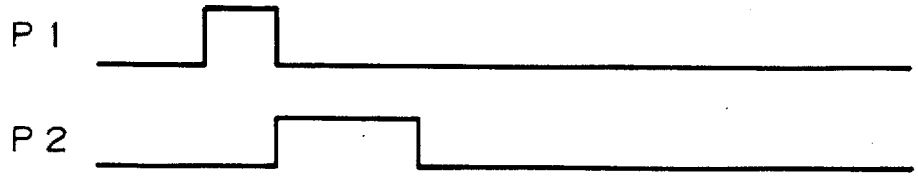

When the motor drivers 21*a* and 21*b* output drive signals P1 and P2 (as shown in FIG. 12C) while the rotor 24 is in the state shown in FIG. 10A, the rotor 24 makes a half turn in the direction B. Further, when the motor drivers 21*a* and 21*b* output drive signals P1 and P2 (shown in FIG. 12D) to the rotor 24 which is in the state shown in FIG. 10B, the rotor 24 also makes a half turn in the direction B. The direction B is assumed to be backward.

According to the invention, the hand 104 is structured so as to rotate clockwise when the motor 6 rotates forward. The magnetic poles of the rotor 24 are positioned as shown in FIG. 10A when the hand 104 is prevented from rotating as shown in FIG. 6C and FIG. 7.

The motor 6 is the bipolar stepping motor as described above, and rotates once so as to turn the rotor 24 half a rotation. A ratio of rotational speed of the rotor 24 to that of the hand wheel 109 i s 30 to 1, which means that the hand 104 takes 60 steps of the motor to rotate once on the dial 101. Each rotation of the rotor 24 per second enables the hand 104 to indicate one second. The hand 104 is secured such that it is at the position of 12 o'clock on the dial 101 when the tooth K of the hand wheel gear 104b is engaged with the first intermediate wheel pinion \a\s\ma so as to prevent the backward movement of the hand wheel 109*b*, i.e. when the gear train is at the reference position 102. Therefore, the magnetic poles of the rotor 24 are at the position shown in FIG. 10A when the hand 104 indicates the even numbers. Conversely, the magnetic poles of the rotor 24 are the position shown in FIG. 10B when the hand 104 indicates the odd numbers.

Figure 12D:
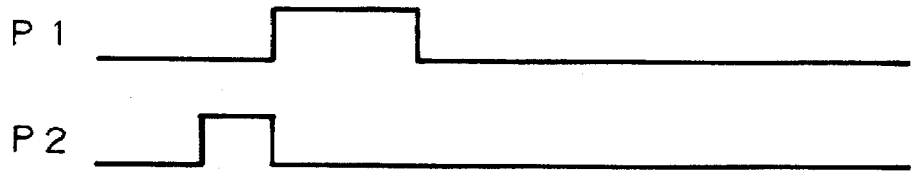

As can be understood from the foregoing, when the hand 104 is at the even-numbered position, the motor drivers 21*a*, 21*b* output the drive signals P1, P2 shown in FIG. 12A. Then, the rotor 24 turns forward. On the contrary, in response to the drive signals P1, P2 shown in FIG. 12C, the rotor 24 turns backward. Even when the drive signals P1, P2 as shown in FIG. 12B or 12D are applied, the rotor 24 does not, however, turn at all.

The system operates in the following manner. When the watch is turned on, the system initialize it so as to make an actual hand position agree with the contents of a hand position counter 11. Specifically, following the actuation of an initialization switch 15, an initializing circuit 14 generates an initializing signal Si. In response to the initializing signal Si, the hand position counter 11 and a time counter 12 clears and resets their counts. Receiving the initializing signal Si, a hand position corrector 10 as an initializing member provides a backward set signal Sbs 60 to a backward movement control circuit 3*b*.

Then, the backward movement control circuit 3*b* provides 60 backward movement command signals Srb to a backward movement waveform shaping circuit 4*b*. In synchronization with the backward movement command signals Srb, the backward movement waveform shaping circuit 4*b* outputs 60 backward rotation pulses Pb. A driver 5 transmits a total of 60 drive signals P1 and P2 alternately to the motor 6.

The hand wheel gear 109*b* has 60 teeth, one of which is the tooth K for preventing the backward movement of the hand 104, as described above. Thus, the hand 104 stops at the reference position 102.

When the initializing switch 15 is turned on, the hand 104 moves backward, returning to the reference position 102. In synchronization with dividing signals FS emitted every second by the divider 2, the forward movement control circuit 3*a* outputs forward movement command signals Srf. In response to the forward movement command signals Srf, a forward movement waveform shaping circuit 4*a* provides a forward rotation pulse Pf to the driver 5. The driver 5 provides the drive signals P1 and P2 (shown in FIGS. 12A and 12B) alternately to the motor 6. The driver 5 first outputs the drive signals P1 and P2 shown in FIG. 12A, followed by the drive signals P1 and P2 shown in FIG. 12B. These drive signals are alternately transmitted in succession. Thus, the motor 6 rotates forward every second.

The hand position counter 11 gradually counts up in synchronization with the forward movement command signals Srf. Further, the time counter 12 counts up in synchronization with the dividing signals Fs. In other words, the count of the hand position counter 11 denotes a currently estimated position of the hand 104.

When the hand position counter 11 counts 60 forward movement command signals Srf, it is checked whether or not the hand 104 is at the reference position 102. First of all, the hand position counter 11 outputs a hand position check command signal Sd. In response to the signal Sd, a hand position confirming circuit 9, as a backward movement command unit, outputs a backward movement setting signal Sbs to a backward movement control circuit 3b. Then, the backward movement control circuit 3b outputs one backward rotation command pulse signal Srb, in synchronization with which a backward movement waveform shaping circuit 4b outputs one backward rotation pulse Pb. In this state, the driver 5 outputs the drive signals P1 and P2 shown in FIG. 12C. These signals are used to return the hand 104 to the odd-numbered position from the even-numbered position on the dial 101.

The hand position confirming circuit 9 outputs a forward movement setting signal Sfs to the forward movement control circuit 3a, which outputs one forward movement command signal Srf. In synchronization with the signal Srf, the forward movement waveform shaping circuit 4a outputs one forward rotation pulse Pf. In this state, the driver 5 outputs the drive signals P1 and P2 shown in FIG. 12B. These drive signals P1 and P2 are for advancing the hand 104 to the odd-numbered position from the even-numbered position on the dial 101.

When the hand 104 operates normally after the watch is initialized, the first intermediate wheel pinion 110a and the hand wheel gear 10b engage with each other such that they prevent the backward movement of the hand 104 when the hand position counter 11 has outputted the signal Sd. Therefore, the hand 104 does not move backwards even when the backward rotation pulse Pb is outputted, and remains at the even-numbered position.

Thereafter, the forward rotation pulse Pf is outputted so as to advance the hand 104 from the odd-numbered position to the even-numbered position. Since the hand 104 actually remains at the even-numbered position, the motor 6 does not rotate forward in response to the forward rotation pulse Pf. In other words, so long as the hand 104 has advanced without any problem after the initialization, it will not be moved for the position confirmation.

When the motor 6 does not rotate forward in spite of the forward rotation pulse Pf for the hand position check, the rotation detector 8 as a backward rotation detector outputs a non-rotation pulse Rn to the hand position confirming circuit 9. In response to the non-rotation pulse Rn, the hand position confirming circuit 9 completes the hand position confirmation.

If the motor 6 does not rotate forward in response to the forward rotation pulses Pf after the initialization, or if the hand 104 erroneously moves due to disturbances, the hand position confirming command signal Sd will be outputted by the hand position counter 11. In such a case, the engagement between the first intermediate wheel pinion 110a and the hand wheel gear 109b is not effective in preventing the backward movement of the hand 104.

In the foregoing case, the hand 104 is supposed to be at either an even-numbered position except for the reference position 102 or at an odd-numbered position on the dial 101. In the former case, when the drive pulses P1 and P2 shown in FIG. 12C are applied in response to the backward movement pulse Pb, the hand 104 is moved backward to the odd-numbered position. In the latter case, the drive pulses P1 and P2 shown in FIG. 12C cannot make the hand 104 move backward. This is because the drive pulses P1 and P2 are essentially for advancing the hand 104 from the even-numbered position to the odd-numbered position. Therefore, in either case, the hand 104 remains at the odd-numbered position after the application of the backward movement pulse Pb.

Thereafter, in response to the forward rotation pulse Pf, the drive circuit 5 provides the drive pulses P1 and P2 (shown in FIG. 12B) so as to advance the hand 104 from the odd-numbered position to the even-numbered position. In this state, the hand 104 stays at the odd-numbered position, so the motor 6 rotates forward in response to the forward rotation pulse Pf. The rotation detector 8 detects the forward rotation of the motor 6 on the basis of the application of the forward rotation pulse Pf, thereby outputting a rotation signal Rg.

When the hand 104 is at the normal reference position 102, the rotation detector 8 outputs the non-rotation signal Rn. Otherwise, the rotation detector 8 outputs the rotation signal Rg. In other words, the rotation detector 8 functions as the hand position determining member, and the signals Rn and Rg denote the results of the determination.

Receiving the rotation signal Rg, the hand position corrector 10 outputs a forward rotation setting signal Sfs 30 to the forward rotation control circuit 3a. Then, the forward rotation control circuit 3a outputs 30 forward rotation command signals Srf. In synchronization with the signals Srf, the forward rotation waveform shaping circuit 4a outputs the forward rotation pulse Pf, and the driver 5 outputs a total of 30 drive signals P1 and P2 (shown in FIGS. 12A and 12B) alternately.

The hand position corrector 10 outputs a backward movement command signal Sbs 60 to the backward movement control circuit 3b, which outputs 60 backward movement command signals Srb. In synchronization with the backward movement command signals Srb, the backward movement waveform shaping circuit 4b outputs the backward movement pulse Pb. Then, the driver 5 outputs 60 drive signals P1 and P2 to the motor 6.

Here, assume that the hand 104 deviates "n" seconds from the reference position 102 prior to the hand position correction. In such a case, a current position n' of the hand 104 will deviate (n+30) seconds from the reference position after the application of 30 forward rotation pulses Pf. Therefore, if "n" is between −30 and 30 (i.e. $-30 \leqq n \leqq 30$), n' will be between 0 and 60 (i.e. $0 \leqq n' \leqq 60$). Thereafter, 60 backward movement pulses Pb are transmitted, so the backward movement of the hand 104 will be prevented during the transmission of these pulses. Thus, it is possible to set the hand 104 at the reference position 102. In other words, the hand position corrector 10 functions as a hand positioning member.

During the hand position correction, the time counter 12 keeps on counting in response to dividing signals Fs from the divider 2 while the hand position counter 11 remains inactive. Therefore, the counts of the time counter 12 and the hand position counter 12 are out of agreement with each other. The hand position corrector 10 outputs a hand position correction end signal Pa to an agreement detector 13, which checks the counts of the foregoing counters 12 and 11. When the counts are out of agreement in the counters 12 and 11, the agreement detector 13 outputs forward rotation setting signals Sfn in accordance with a difference between the counts of the counters 12 and 11. The forward rotation control circuit 3a outputs as many forward rotation command signals Srf as the forward rotating setting signals Sfn. In synchronization with the forward rotation command signals Srf, the forward rotation waveform shaping circuit 4a outputs forward rotation pulses Pf. Thus, the hand 104 is corrected to a position indicative of a current time.

The foregoing hand position correcting process can reliably correct the position of the hand 104 so long as the hand 104 deviates from the reference position 102 within a half of its rotation cycle on the dial 101. Specifically, even when the hand 104 is moved forward for 30 second and backward for 60 seconds, it is possible to keep good time indications of minute and hour hands whose operations are relative to the hand 104 (i.e. the second hand in this embodiment). It is needless to say that when the hand 104 is a hand of a stopwatch, for example, the position of the hand 104 can be corrected without adversely affecting the hour or minute hand by obviating the step of applying 30 forward rotation pulses.

Assume that the hand 104 keeps on operating normally after the initialization. In this case, the position of the hand 104 can be confirmed without being noticed by the user since the hand 104 is not actually moved. The hand position can be confirmed without any problem whenever the hand 104 is at the reference position 102. However, the hand position confirmation is performed by twice outputting pulses which do not have anything to do with the hand rotation, which means that extra current is consumed for this purpose. In order to save power considering the life of a battery, it is preferable to perform the hand position confirmation at intervals which are several integer times longer than the cycle in which the hand returns to the reference position.

Rotations of the motor 6 will be detected in the following manner. A driving force for the motor 6 to rotate the hand is designed to be minimum so as to reduce power consumption. In other words, a width of the drive pulse of the motor 6 is set to be minimum for rotating the hand 104. If the hand does not move in response to the drive pulse due to a variation of a load, another pulse having a larger drive force than that of the drive pulse will be outputted. A rotation detector used in this method monitors a counter electromotive voltage generated by the motor 6 immediately after outputting the drive pulse, and checks whether the motor 6 has rotated or not, on the basis of a generating pattern of the counter electromotive voltage.

When the motor 6 is mechanically blocked so as not to rotate as in the present invention, it is rather difficult to generate a counter electromotive voltage. Even when the counter electromotive voltage is generated, a position for mechanically blocking the rotation of the motor 6 may shift in accordance with a phase angle thereof due to variable manufacturing accuracy. Therefore, the counter electromotive voltage may vary in the motor 6. This will make it difficult to determine non-rotation of the motor 6. In order to overcome this problem, the backward movement command is first issued, and then the forward rotation command is provided. It is checked whether or not the motor 6 is rotated forward in response to the forward rotation command. In other words, this forward rotation of the motor 6 implies that it has actually rotated backward in response to the backward movement command.

Assume that the hand 104 operates abnormally after the initialization, and that the position of the hand 104 is checked at a position other than the reference position 102. In such a case, the motor 6 is made to rotate backward in response to the backward movement command, and then rotate forward in response to a succeeding forward rotation command. In this state, the position of the hand 104 will be checked. However, if the motor 6 does not rotate in response to the forward rotation command due to a factor such as a load variation, the system of this embodiment erroneously determines that the hand 104 is at the reference position 102 even when it is not there. In order to overcome such a problem, the forward rotation pulse should have sufficient power for rotating the motor 6 reliably.

In the foregoing embodiment, the hand wheel gear **109*b* has 60 teeth, and the hand 104 serves as the second hand. It is needless to say that the hand wheel gear 109*b* may have a desired number of teeth depending upon the function of the hand 104**.

Alternatively, the pulses shown in FIGS. 12C and 12D may be used to actuate the motor 6, thereby rotating the hand 104 clockwise, and the pulses shown in FIGS. 12A and 12B may be used to actuate the motor 6 so as to move the hand 104 counterclockwise.

What is claimed is:

1. A hand rotating mechanism for an electronic watch in which at least a hand is rotated forward and backward by a motor converting an electrical signal from a control circuit into the rotary motion, the hand rotating mechanism comprising:

(a) a backward movement preventing mechanism for preventing only the backward movement of the hand only at a predetermined backward movement preventing position;

(b) a backward movement commanding circuit for commanding the motor to move the hand backward when a position of the hand estimated on the basis of the electrical signal agrees with the backward movement preventing position;

(c) a backward movement detecting circuit for detecting that the hand actually moves backward; and (d) a hand position determining circuit for determining that an actual position of the hand agrees with the estimated position when the backward movement of the hand is not detected, and determining that the actual position of the hand deviates from the estimated position when the backward movement of the hand is detected.

2. The hand rotating mechanism as in claim 1 further including a positioning circuit for repositioning the hand at the estimated position when the hand is not at the estimated position.

3. The hand rotating mechanism as in claim 2, wherein the positioning circuit issues a command for the motor to cause the hand to make less than one forward rotation and thereafter to cause the hand to make one backward rotation.

4. The hand rotating mechanism as in claim 2, wherein the positioning circuit issues a command for the motor to cause the hand to make less than one forward rotation and thereafter to let the hand make one backward rotation, calculates time for repositioning the hand, and demands the motor to rotate the hand on the basis of the calculated time.

5. The hand rotating mechanism as in claim 1, wherein the motor is controlled such that rotational torque for rotating the hand in response to the backward movement command is larger than that for a usual movement of the hand.

6. A hand rotating mechanism for an electronic watch in which at least a hand is rotated forward and backward by a motor converting an electrical signal from a control circuit into the rotary motion, the hand rotating mechanism comprising:

(a) a backward movement preventing mechanism for preventing the backward movement of the hand only at a predetermined backward movement preventing position;

(b) a backward movement commanding circuit for commanding the motor to move the hand backward when a position of the hand estimated on the basis of the electrical signal agrees with the backward movement preventing position;

(c) a backward movement detecting circuit for detecting that the hand actually moves backward; and (d) a hand position determining circuit for determining that an actual position of the hand agrees with the estimated position when the backward movement of the hand is not detected, and determining that the actual position of the hand deviates from the estimated position when the backward movement of the hand is detected;

wherein the motor is a stepping motor, the backward movement commanding circuit commands the motor to move the hand backward first and then move it forward, and the backward movement detecting circuit detects whether or not the hand actually moves forward in response to the forward movement command after the backward movement command, and determines that the motor actually rotates backward when the forward movement of the hand is detected.

7. The hand rotating mechanism as in claim 6, wherein the motor is controlled such that rotational torque for moving the hand in response to the backward movement command is larger than that for the usual rotation of the hand.

8. The hand rotating mechanism as in claim 6, wherein the backward rotating commanding circuit commands the motor to move the hand backward when the number of times in which the estimated position of the hand agrees with the backward movement preventing position becomes larger than a given value.

9. A hand rotating mechanism for an electronic watch in which at least a hand is rotated forward and backward by a motor converting an electrical signal from a control circuit into the rotary motion, the hand rotating mechanism comprising:

(a) a backward movement preventing mechanism for preventing the backward movement of the hand only at a predetermined backward movement preventing position;

(b) a backward movement commanding circuit for commanding the motor to move the hand backward when a position of the hand estimated on the basis of the electrical signal agrees with the backward movement preventing position;

(c) a backward movement detecting circuit for detecting that the hand actually moves backward; and (d) a hand position determining circuit for determining that an actual position of the hand agrees with the estimated position when the backward movement of the hand is not detected, and determining that the actual position of the hand deviates from the estimated position when the backward movement of the hand is detected; and a gear train for transmitting the rotation of the motor to the hand, and one of the gears in the gear train has at least one tooth functioning as the backward movement preventing mechanism.

10. The hand rotating mechanism as in claim 9, wherein one of the teeth of the gear functioning as the backward movement preventing mechanism has a projecting portion which comes into engagement with a tooth of the mating gear in the gear train during the backward movement of the hand.

11. The hand rotating mechanism as in claim 10, wherein the other tooth of the gear functioning as the backward movement preventing mechanism is a third tooth viewed from the tooth having the projecting tip in the forward rotating direction and is slender on a side thereof where it comes into engagement with a tooth of the mating gear in the gear train during the backward movement of the hand.

12. The hand rotating mechanism as in claim 11, wherein the other tooth of the gear functioning as the backward movement preventing mechanism is a second tooth viewed from the tooth having the projecting tip in the forward rotating direction and is slender on a side thereof where it comes into engagement with another tooth of the mating gear in the gear train during the backward movement of the hand.

13. The hand rotating mechanism as in claim 9 further including initializing circuit for demanding the motor to move the hand backward and to return the hand to the backward movement preventing position during initialization.

14. The hand rotating mechanism as in claim 9 further including a positioning circuit for repositioning the hand at the estimated position when the hand is not at the estimated position.

15. The hand rotating mechanism as in claim 14, wherein the positioning circuit issues a command for the motor to cause the hand to make less than one forward rotation and thereafter to cause the hand to make one backward rotation.

16. The hand rotating mechanism as in claim 14, wherein the positioning circuit issues a command for the motor to cause the hand to make less than one forward rotation and thereafter to let the hand make one backward rotation, calculates time for repositioning the hand, and demands the motor to rotate the hand on the basis of the calculated time.

17. The hand rotating mechanism as in claim 9, wherein the motor is controlled such that rotational torque for rotating the hand in response to the backward movement command is larger than that for a usual movement of the hand.

18. A hand rotating mechanism for an electronic watch in which at least one hand is moved forward and backward by a motor converting an electrical signal from a control circuit into rotary motion, the hand rotating mechanism comprising:

(a) a backward movement preventing mechanism for preventing the backward movement of the hand only at a predetermined backward movement preventing position; and (b) an initializing circuit for demanding the motor to move the hand backward toward the backward movement preventing position during initialization (c) a gear train for transmitting the rotation of the motor to the hand, and one of the gears in the gear train has at least one tooth functioning as the backward movement preventing mechanism.

19. The hand rotating mechanism as in claim 14, wherein one of the teeth of the gear functioning as the backward movement preventing mechanism has a projecting portion which comes into engagement with a tooth of the mating gear in the gear train during the backward movement of the hand.

20. The hand rotating mechanism as in claim 19, wherein the other tooth of the gear functioning as the backward movement preventing mechanism is a third tooth viewed from the tooth having the projecting portion in the forward rotating direction and is slender on a side thereof where it comes into engagement with a tooth of the mating gear in the gear train during the backward movement of the hand.

21. The hand rotating mechanism as in claim 20, wherein the other tooth of the gear functioning as the backward movement preventing mechanism is a second tooth viewed from the tooth having the projecting tip in the forward rotating direction and is slender on a side thereof where it comes into engagement with another tooth of the mating gear in the gear train during the backward movement of the hand.

22. A hand rotating mechanism for an electronic watch, comprising:

a control circuit;

a motor for rotating a hand forward and backward, the motor being operated by an electrical signal from the control circuit;

a backward movement preventing mechanism for preventing the backward movement of the hand only at a predetermined backward movement preventing position;

a backward movement commanding circuit for commanding the motor to move the hand backward when a position of the hand estimated on the basis of the electrical signal agrees with the backward movement preventing position;

a backward d movement detecting circuit for detecting that the hand actually moves backward; and a hand position determining circuit for determining that an actual position of the hand agrees with the estimated position when the backward movement of the hand is not detected, and for determining that the actual position of the hand deviates from the estimated position when the backward movement of the hand is detected.

* * * * *